US009076414B1

(12) United States Patent
Dunnett

(10) Patent No.: US 9,076,414 B1
(45) Date of Patent: Jul. 7, 2015

(54) REINFORCED DRUM SHELL

(71) Applicant: Ronn Dunnett, Delta (CA)

(72) Inventor: Ronn Dunnett, Delta (CA)

( * ) Notice: Subject to any disclaimer, the term of this patent is extended or adjusted under 35 U.S.C. 154(b) by 0 days.

(21) Appl. No.: 14/254,600

(22) Filed: Apr. 16, 2014

(51) Int. Cl.
*G10D 13/02* (2006.01)

(52) U.S. Cl.
CPC ..... *G10D 13/028* (2013.01)

(58) Field of Classification Search
CPC ..... G10D 13/028
See application file for complete search history.

(56) References Cited

U.S. PATENT DOCUMENTS

| | | | | | |
|---|---|---|---|---|---|
| 1,420,233 | A | * | 6/1922 | Baldwin et al. | 84/411 R |
| 1,828,083 | A | | 9/1929 | Strupe | |
| 3,635,119 | A | | 1/1972 | Thompson | |
| 3,911,779 | A | * | 10/1975 | Della-Porta | 84/411 R |
| 3,981,220 | A | | 9/1976 | Clark | |
| 4,356,757 | A | * | 11/1982 | Mooy | 84/411 R |
| 5,025,697 | A | * | 6/1991 | May | 84/411 R |
| 5,301,591 | A | * | 4/1994 | Greenberg | 84/411 R |
| 5,377,576 | A | * | 1/1995 | Good et al. | 84/411 R |
| 5,587,544 | A | * | 12/1996 | Fujii et al. | 84/411 R |
| 5,895,873 | A | | 4/1999 | Yanagisawa | |
| 6,265,650 | B1 | | 7/2001 | Arbiter | |
| 7,361,823 | B2 | | 4/2008 | Rush | |
| 7,718,876 | B1 | | 5/2010 | Good | |
| 7,781,659 | B2 | | 8/2010 | Liao | |
| 7,812,236 | B1 | * | 10/2010 | Good | 84/411 R |
| 7,888,574 | B1 | | 2/2011 | Acoutin | |
| 8,330,030 | B1 | | 12/2012 | Wang | |
| 2006/0249005 | A1 | * | 11/2006 | Rush | 84/411 R |
| 2009/0173209 | A1 | | 7/2009 | Abe et al. | |

* cited by examiner

*Primary Examiner* — Robert W Horn
(74) *Attorney, Agent, or Firm* — Dwayne E. Rogge; Schacht Law Office, Inc.

(57) ABSTRACT

Disclosed herein is a hybrid edge drum shell having unpaired edges. The drum shell includes a substantially cylindrical drum wall having an upper edge and a lower edge; a sloped surface angled radially inward and vertically downward from the upper edge; the sloped surface having an inner edge radially inward and vertically below the upper edge; and wherein the lower edge of the drum wall is not substantially radially inward therefrom. The drum shell may be made of metal, wood, composites, or other materials.

6 Claims, 3 Drawing Sheets

REINFORCED DRUM SHELL

BACKGROUND OF THE DISCLOSURE

Field of the Disclosure

This disclosure relates to the field of percussion drum shells as a musical instrument. The disclosure finds particular relevance in the field of snare drums.

BRIEF SUMMARY OF THE DISCLOSURE

Disclosed herein is a hybrid edge drum shell comprising: a substantially cylindrical drum wall having an upper edge and a lower edge; a sloped surface angled radially inward and vertically downward from the upper edge; the sloped surface having an inner edge radially inward and vertically below the upper edge; and wherein the lower edge of the drum wall is not substantially radially inward therefrom. The drum shell may be made of metal, wood, composites, or other materials. In FIG. 3 is shown one example where the upper section 54, middle section 56, and/or lower section 58 may be made of different materials in different combinations. For example, the upper section 54 and lower section 56 may be made of metal, with the middle section comprising wood, or being covered in a laminate of wood. In another example, the upper section 54 may be made of metal with all other sections made of wood. These combinations are applicable to each example.

The hybrid edge metal drum shell as recited may be arranged wherein the sloped surface is a unitary body with the cylindrical drum wall.

The hybrid edge metal drum shell as recited may further comprise snare beds formed in radially opposing sides of the lower edge of the cylindrical drum wall.

The hybrid edge metal drum shell as recited may be arranged wherein the snare beds are concave vertical indentations.

The hybrid edge metal drum shell as recited may be arranged wherein the sloped surface is substantially linear in cross section, or may be curved, or arcuate.

DETAILED DESCRIPTION OF THE DISCLOSURE

This invention relates generally to drumming apparatus, and more particularly to improvements to the bearing edges of a metal drum, where the edges are milled or formed on the top and bottom of the shell specifically to the function of each side of the drum where one side of the drum has a head that is directly struck (batter side) and the reverse side which resonates sympathetically (resonant side).

Figure 1:
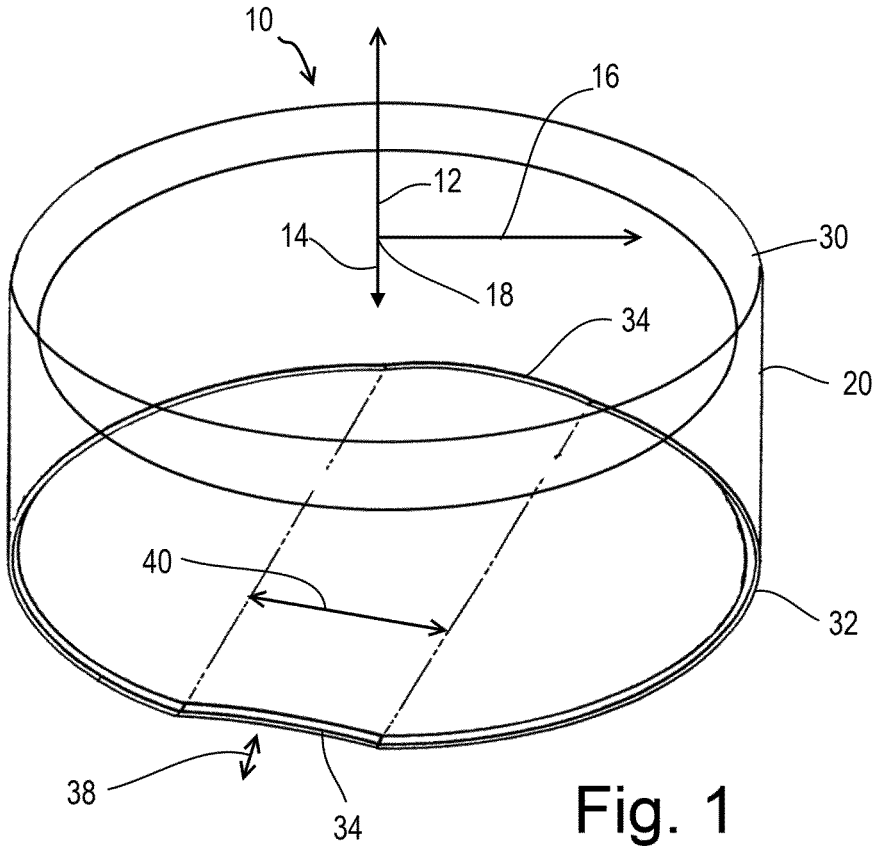
FIG. 1 is an isometric hidden line view of one example of a hybrid edge metal drum shell.
Figure 2:
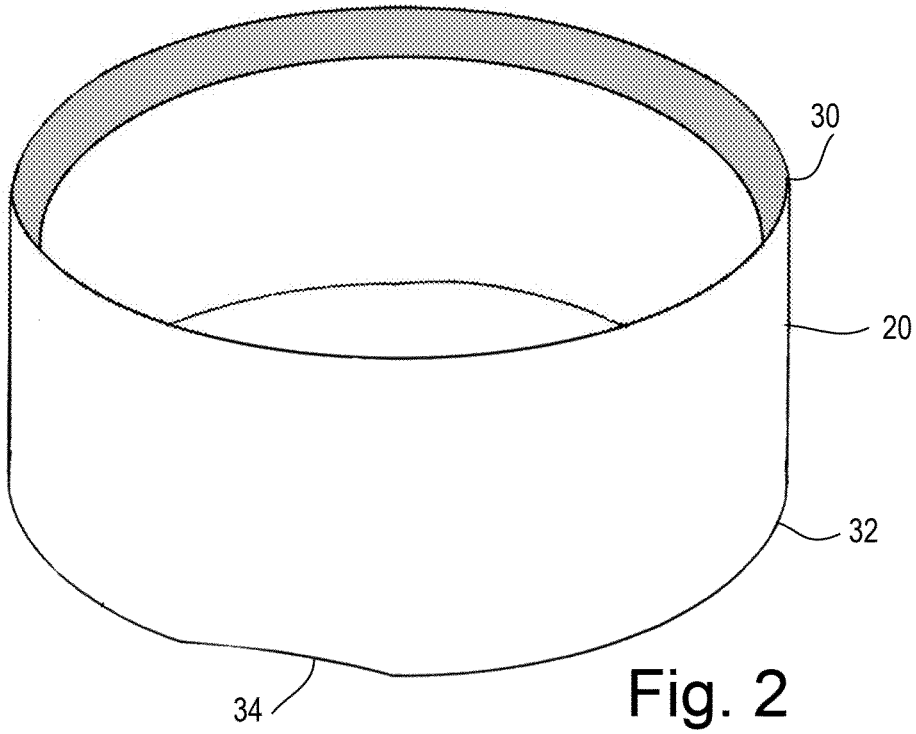
FIG. 2 is an isometric view of one example of a hybrid edge metal drum shell.

Looking to FIG. 1 is shown an axes system 10 including a vertical axis 12 pointing in an upwards direction and a vertical axis 14 pointing in a downward direction assuming that the drum is oriented with the drumhead in a horizontal plane. Likewise, a radially outward axis 16 is shown centered upon the radial center 18 of the drum shell 20 and pointing radially outward therefrom orthogonal to the vertical axis. These orientations are intended to ease in explanation and not intended to limit the apparatus to a particular orientation during use or during interpretation of the claims.

With respect to a drum such as a snare drum 22, improvements to the increased variability of the response of multiple strands (snares) 24 that co-act with a drumhead 26/28 to produce desired acoustic effects.

In the past, metal drum shells have been milled or formed so that the top 30 and bottom 32 bearing edges of the drum are identical. Those edges are formed so that they angle inward, toward the radial center 18 of the drum and are formed at various angles. In one example these angles range from 30 to 45 degrees. In the case of metal snare drum shells, the bottom or snare side edge 32 differs from the top (batter) edge 30 in that there are usually diametrically opposed indentations (snare beds) 34 that are milled or formed into the edge 32 to facilitate the effect of the snares 24 against the drum head 28. In FIG. 1, dashed lines are shown to indicate the width of the snare beds, and to show their radial alignment to the each other. Metal drum shells have also been made with edges that are not formed, but are straight/substantially parallel to the main body of the drum shell. This method of production at times adversely affects the sound or tone of the drum and the performance of the snare effect when assembled onto drum heads struck by a beater.

Disclosed herein is a metal drum shell 20 with hybrid edges 30/32, in which one edge is formed radially inward and downward and one edge is substantially straight.

Generally drums employ drumheads 26/28 that differ by the number of plies and the thickness of the plies. Drum heads are selected specifically and in such a way as to provide the player with the desired tone, resonance, response and, in the case of snare drums, the desired snare effect. For example, a double ply head may be used on the batter side 26 and a one ply head may be used on the resonant side 28. In the case of a snare drum, a special extra thin head is often preferred as it provides a desirable reaction with snare wires 24.

By creating a metal drum shell 20 that has edges that are specific to the function of each side of the drum, the tone, resonance, response and snare effect are greatly improved.

In the example of a tom-tom, having a metal shell with a formed batter side edge and a non-formed or straight-edge type edge generally produces a warmer tone on the batter side and increased resonance on the resonate side due to the reduced contact area between the drum edge and the drumhead. Tom-tom drums are usually cylindrical drums with no snare set.

In the example of a metal snare drum, the snare side edge 32 must often be crimped or deformed to create the snare bed 34. This method of production limits the depth 38 and width 48 of the snare bed 34 and also reduces the amount of tone and resonance of the drum and limits the variability and response of the snare effect. This method also limits the types of snare wires 24 that can be used, as in the case of snare sets with a high number of snare wires 24. Snare wires 24 that sit outside of the channel or depression in the snare side head that is created by the snare beds do not respond the same as snare wires 24 that are within the channel. Metal shell snare drums with straight edges are not limited by the forming or milling process and the snare beds can be installed at any depth or width without impacting the functionality of the drum shell.

A metal drum shell that has a formed edge on one side 30 and a straight edge on the opposing side 32 allows the drum an increased amount of control over the tone, resonance and response of the drum.

In the case of a snare drum, a metal shell 20 with a formed edge 30 on the batter side 26 and a straight edge on the snare side 28 allows the drum an increased amount of control over the tone, resonance and response of the drum and of the snare effect, and further allows a wider range of snare types to be employed.

Figure 3:
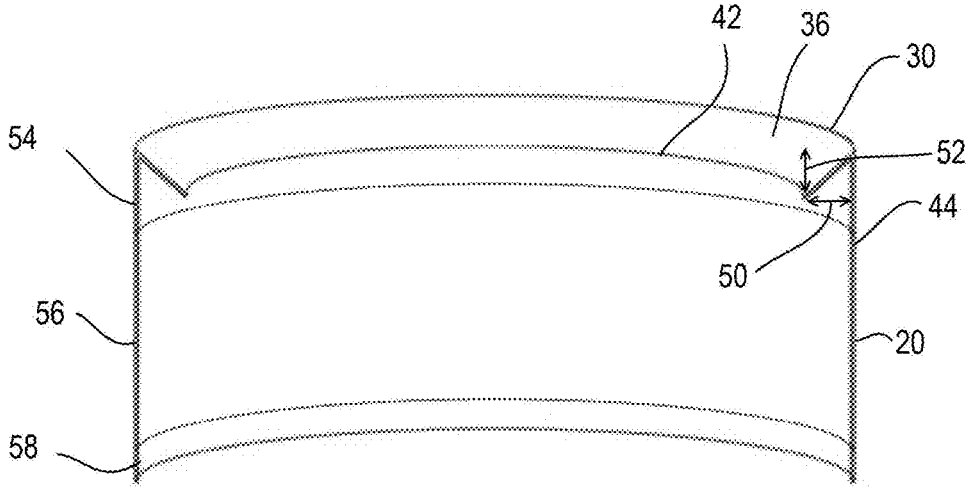
FIG. 3 is a cutaway view of the example shown in 1 of a hybrid edge metal drum shell.

Looking with more detail to FIG. 3, the drum shell 20 is shown separated from all other components. It can be seen how the upper or batter edge 30 which engages the upper drumhead 26 is adjacent to and inward and downward sloping surface 36. This sloping surface 36 being angled between 5° and 85° from horizontal. A preferred range may be between 30° and 55° from horizontal. The sloping surface 36 has a radially inward and downward edge 42. The sloping surface 36 is not to be confused with a rolled over edge as found in some metal drum shells where in the sloping surface is rolled back to be substantially parallel to the cylindrical drum wall 44.

Figure 4:
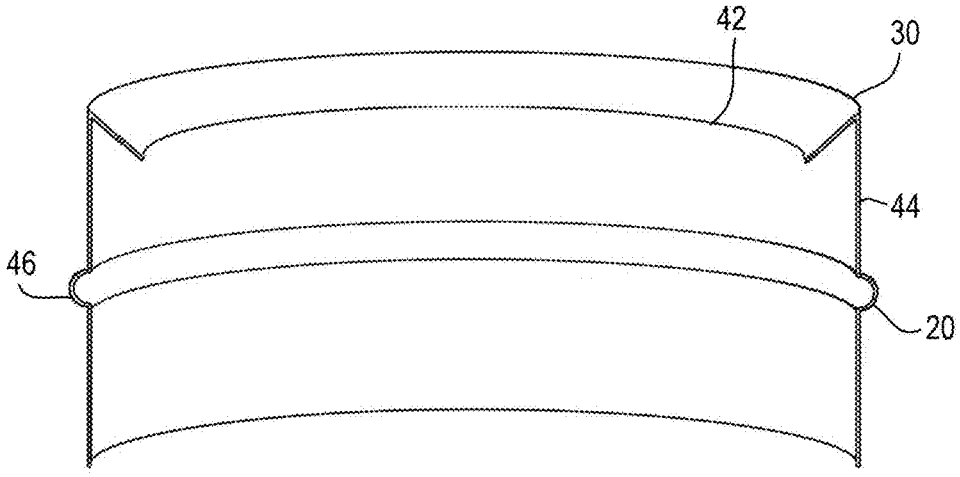
FIG. 4 is a cutaway view of another example of a hybrid edge metal drum shell.
Figure 5:
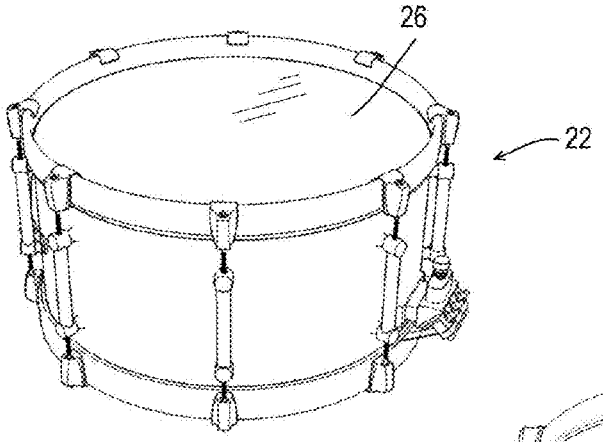
FIG. 5 is a top isometric view of a hybrid edge metal snare drum.
Figure 6:
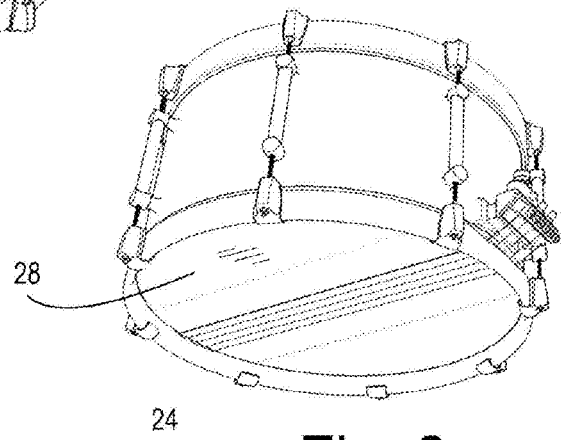
FIG. 6 is a bottom isometric view of a hybrid edge metal snare drum.
Figure 7:
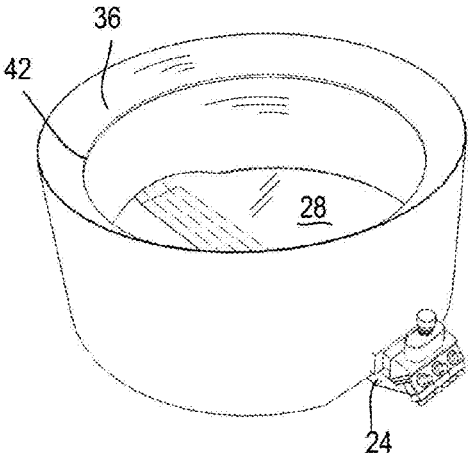
FIG. 7 is an isometric view of one example of a hybrid edge metal drum shell.
Figure 8:
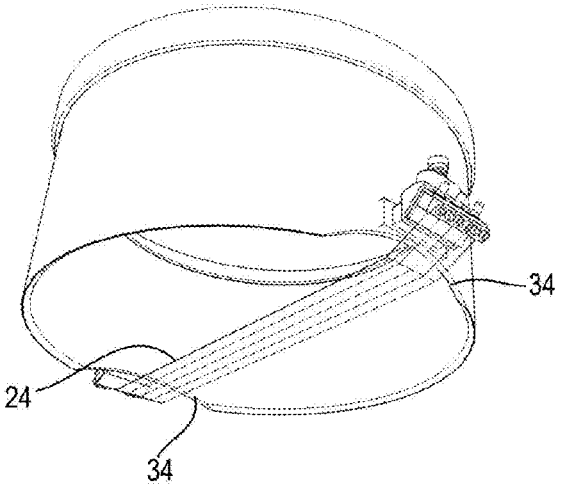
FIG. 8 is an isometric top view of one example of a hybrid edge metal drum shell with snares attached.

Looking to FIG. 4, the drum shell 20 including the cylindrical drum wall 44 has a reinforcement bead 46 formed therein so as to form a convex surface on the inner side of the drum wall 44 and a convex surface on the outer side of the drum wall 44. Similar reinforcement beads have been used in other prior art drum shells.

In one form the sloped surface 36 is a unitary body with the cylindrical drum wall 44. This means that the sloped surface 36 is not attached to the drum wall 44 but is a rolled-over or bent portion of the same body. In some examples there is a visual horizontal gap (space) 50 between the inner edge 42 and the drum wall 44, as well as a vertical gap (space) 52 between the upper edge 30 of the drum wall and the inner edge 42 of the sloping surface.

In another example, the sloped surface 36 may be formed separately and attached to the cylindrical drum wall 44 or a portion thereof.

Although shown as a curved surface which is linear in cross section (see FIG. 3), the sloping surface 36 could be curved, or segmented linear surfaces. The sloped surface also may be formed with cuts so as to be non-continuous circumferentially.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A hybrid edge metal drum shell comprising:

a. a substantially cylindrical drum wall having an upper edge and a lower edge;

b. a sloped surface angled radially inward and vertically downward from the upper edge;

c. the sloped surface having an inner edge radially inward and vertically below the upper edge; and d. wherein the lower edge of the drum wall is not substantially radially inward therefrom.

2. The hybrid edge metal drum shell as recited in claim 1 wherein the sloped surface is a unitary body with the cylindrical drum wall.

3. The hybrid edge metal drum shell as recited in claim 2 wherein the sloped surface is formed by the process of rolling over a portion of the cylindrical drum wall.

4. The hybrid edge metal drum shell as recited in claim 1 further comprising snare beds formed in radially opposing sides of the lower edge of the cylindrical drum wall.

5. The hybrid edge metal drum shell as recited in claim 4 wherein the snare beds are concave vertical indentations.

6. The hybrid edge metal drum shell as recited in claim 1 wherein the sloped surface is substantially linear in cross section.

* * * * *